US010898867B2

(12) United States Patent
Beery et al.

(10) Patent No.: US 10,898,867 B2
(45) Date of Patent: Jan. 26, 2021

(54) DEVICE AND METHOD FOR GENERATING GAS BUBBLES IN A LIQUID

(71) Applicant: akvola Technologies GmbH, Berlin (DE)

(72) Inventors: Matan Beery, Berlin (DE); Gregor Tychek, Berlin (DE); Johanna Ludwig, Berlin (DE)

(73) Assignee: Akvola Technologies GmbH, Berlin (DE)

( * ) Notice: Subject to any disclaimer, the term of this patent is extended or adjusted under 35 U.S.C. 154(b) by 267 days.

(21) Appl. No.: 15/572,861

(22) PCT Filed: May 11, 2016

(86) PCT No.: PCT/EP2016/060504
§ 371 (c)(1),
(2) Date: Nov. 9, 2017

(87) PCT Pub. No.: WO2016/180853
PCT Pub. Date: Nov. 17, 2016

(65) Prior Publication Data

US 2018/0104659 A1 Apr. 19, 2018

(30) Foreign Application Priority Data

May 11, 2015 (DE) ..... 10 2015 208 694

(51) Int. Cl.
*B01F 3/04* (2006.01)
*B01F 7/10* (2006.01)

(52) U.S. Cl.
CPC ..... *B01F 3/04588* (2013.01); *B01F 7/10* (2013.01); *B01F 7/105* (2013.01); *B01F 2003/04546* (2013.01); *B01F 2003/04567* (2013.01)

(58) Field of Classification Search
CPC ..... B01F 3/04588; B01F 7/105; B01F 2003/04546; B01F 2003/04567; B01F 7/10
USPC ..... 261/87, 92
See application file for complete search history.

(56) References Cited

U.S. PATENT DOCUMENTS 2,540,948 A 2/1951 Jeffery
2,996,287 A * 8/1961 Audran ..... B01F 7/1625 366/265
3,108,146 A 10/1963 Gross
4,193,949 A * 3/1980 Naito ..... B01F 3/04539 210/219

(Continued)

FOREIGN PATENT DOCUMENTS

CN 101529192 B 2/2011
CN 203741077 U 7/2014

(Continued)

*Primary Examiner* — Charles S Bushey
(74) *Attorney, Agent, or Firm* — The Webb Law Firm

(57) ABSTRACT

The invention relates to a device for generating gas bubbles in a liquid in a container, including at least one rotatable hollow shaft arranged horizontally in at least one container; at least one gassing disc arranged vertically on the at least one hollow shaft; and at least one feed line for supplying at least one compressed gas to the interior of the at least one hollow shaft, said compressed gas being brought into the feed line and hollow shaft directly, without a liquid carrier.

22 Claims, 5 Drawing Sheets

(56) References Cited

U.S. PATENT DOCUMENTS

| | | | | |
|---|---|---|---|---|
| 4,193,950 | A * | 3/1980 | Stockner | B01F 3/04539 261/87 |
| 4,228,112 | A | 10/1980 | Hise | |
| 4,267,051 | A * | 5/1981 | Uhlmann | B01F 3/04765 210/619 |
| 4,303,470 | A | 12/1981 | Meredith et al. | |
| 5,490,727 | A | 2/1996 | Poschl | |
| 5,626,819 | A * | 5/1997 | Novello | A61M 1/32 261/92 |
| 7,029,584 | B2 * | 4/2006 | Blase | B01D 33/21 210/331 |
| 7,322,565 | B2 | 1/2008 | Buse et al. | |
| 2002/0070467 | A1 * | 6/2002 | Sherman | B01F 3/04262 261/87 |
| 2003/0150794 | A1 * | 8/2003 | Blase | B01D 33/21 210/498 |
| 2006/0144775 | A1 * | 7/2006 | Feuerpeil | B01D 33/21 210/321.68 |
| 2007/0119765 | A1 | 5/2007 | Beaule et al. | |
| 2010/0065250 | A1 | 3/2010 | Frommann | |
| 2010/0258509 | A1 | 10/2010 | Iwaki et al. | |
| 2015/0114910 | A1 | 4/2015 | Repke et al. | |

FOREIGN PATENT DOCUMENTS

| | | | |
|---|---|---|---|
| CN | 104525016 | A | 4/2015 |
| DE | 1940779 | A1 | 2/1970 |
| DE | 2643691 | C2 | 3/1986 |
| DE | 4223434 | C1 | 11/1993 |
| DE | 19620040 | C2 | 10/1998 |
| DE | 102004003033 | A1 | 8/2005 |
| DE | 60316996 | T2 | 7/2008 |
| EP | 2153886 | A1 | 2/2010 |
| EP | 2081666 | B1 | 10/2011 |
| GB | 2114469 | A | 8/1983 |
| JP | S49102375 | U | 9/1974 |
| JP | S5134927 | U | 8/1976 |
| JP | S54127221 | U | 9/1979 |
| JP | 5567317 | A | 5/1980 |
| JP | 5938834 | B2 | 9/1984 |
| JP | 60153988 | A | 8/1985 |
| JP | 4171036 | A | 6/1992 |
| JP | 2000117264 | A | 4/2000 |
| JP | 2002001310 | A | 1/2002 |
| WO | 2008013349 | A1 | 1/2008 |
| WO | 2013167358 | A1 | 11/2013 |

* cited by examiner

DEVICE AND METHOD FOR GENERATING GAS BUBBLES IN A LIQUID

CROSS-REFERENCE TO RELATED APPLICATIONS

This application is the United States national phase of International Application No. PCT/EP2016/060504 filed May 11, 2016, and claims priority to German Patent Application No. 102015208694.1 filed May 11, 2015, the disclosures of which are hereby incorporated in their entirety by reference.

BACKGROUND OF THE INVENTION

Field of the Invention

The present invention relates to a device for generating gas bubbles in a liquid, a method for generating gas bubbles in a liquid using a device, a system for water purification comprising a device, and a method for water purification using a system.

Description of Related Art

Gas bubbles in liquids are necessary for a variety of different applications, such as, for example, in order to dissolve gas in the liquid. An area of application of gas bubbles in liquids that is becoming increasingly interesting and important is the purification of water and other liquids by the so-called flotation method.

Flotation is a gravity separation process for the separation of solid-liquid or liquid-liquid systems. In this process, gas bubbles, for example of air, are produced and introduced into the liquid phase, wherein hydrophobic particles contained in the liquid phase, such as, for example, organic substances or biological degradation products, attach themselves to these likewise hydrophobic bubbles and rise to the surface due to the buoyancy caused by the gas bubbles. At the surface of the liquid phase, these agglomerates collect to form a layer of sludge that can easily be mechanically separated.

In this case, the greater the specific area of the rising gas to which the hydrophobic particles from the water to be purified can attach themselves, the greater the flotation effect. Accordingly, the formation of minute bubbles with diameters of 10 to 100 μm in the form of bubble froth (also referred to as white water) is desirable.

A possibility for introducing gas in the form of minute bubbles into the liquid to be purified is provided by the known DAF (dissolved air flotation) method. In this method, a gas present in dissolved form in a liquid at elevated pressure is introduced into the liquid to be purified, and because of the pressure drop in the liquid to be purified, the gas escapes in the form of minute bubbles which have a diameter in the μm range. The DAF method allows highly favorable separation of microalgae and other minute organisms, oils, colloids, and other organic and inorganic particles from high-load wastewater, but requires a relatively large amount of energy because of the introduction of air into the liquid using a saturation column, which entails high energy consumption. At high temperatures (greater than 30° C.) and salt contents (greater than 30,000 ppm), the method works less and less efficiently or not at all.

A further possibility for introducing minute gas bubbles into a liquid while avoiding the high energy consumption of the DAF method is described, among other documents, in WO 2013/167358 A1, in which introduction of gas is carried out by direct injection via a gassing membrane into the liquid to be purified. In this case, there is no need for the recycling stream and the saturation column otherwise required in the DAF method, as the gas can be removed, for example, directly from a compressed air line or a gas canister.

In WO 2008/013349 A1, ceramic discs are used to produce microbubbles for separating impurities in wastewater, wherein the ceramic discs have an average pore size of between 0.01 μm and 0.05 μm. However, such small pore sizes are by no means practical, for example in the use of salt water or highly polluted water such as water containing sludge, as water containing salt or sludge has a higher density or viscosity than normal water and clogs the small pores of the ceramic discs. The smaller the pore size, the more difficult it is to produce bubbles on immersed porous surfaces and thus the greater the energy required for this purpose. The membrane and device described in WO 2008/013349 A1 are therefore by no means economically suitable for large-scale industrial use.

Another approach for the production of minute bubbles is described in EP 2081666 B1, wherein in this case, the production of minute bubbles takes place by means of oscillation. In the described method, a compressed gas flowing into a line is caused to oscillate without accompanying oscillation of the gas line. The oscillation is produced by means of a fluidic oscillator, wherein the oscillations produced are such that they cause gas reflux of 10 to 30% from an emerging gas bubble. The oscillations generated by the fluidic oscillator are at a frequency of between 1 and 100 Hz, preferably between 5 and 50 Hz, and more preferably between 10 and 30 Hz, and the bubbles thus formed have a diameter of between 0.1 and 2 mm. However, the production of minute bubbles (less than 100 μm) for large-scale industrial use is not possible with the device described in EP 2081666 B1.

An object of the following invention is therefore to provide a device and a method for generating gas bubbles in a liquid which allows economical and practical large-scale industrial use, more particularly in the purification of wastewater or salt water.

SUMMARY OF THE INVENTION

According thereto, a device is provided for generating gas bubbles in a liquid, more particularly in a salt-containing and/or highly polluted liquid, which comprises at least one rotatable hollow shaft arranged horizontally in at least one container, at least one, preferably at least two, and more particularly at least three or more gassing discs arranged vertically on the horizontally rotatable hollow shaft, and at least one feed line for supplying at least one compressed gas to the interior of the at least one rotatable hollow shaft, wherein the compressed gas is directly brought into the feed line and the hollow shaft without a liquid carrier.

According to the invention, the at least one hollow shaft comprises at least one first hollow shaft with a diameter $d_{3a}$ and a second hollow shaft with a diameter $d_{3b}$, wherein $d_{3a}<d_{3b}$, such that the first hollow shaft is arranged inside the second hollow shaft. Accordingly, the hollow shaft is composed of two (partial) hollow shafts which lie inside or are nested into one another: a first (partial) hollow shaft of smaller diameter that is arranged inside a second (partial) hollow shaft of large diameter. The diameter of the inner and outer hollow shafts can be between 10 and 50 mm, e.g. 10, 20, and/or 40 mm.

The compressed gas is preferably supplied to the interior of the first (smaller) hollow shaft. As the at least one first rotatable (smaller) hollow shaft is composed of a gas-permeable material (such as a perforated material), the gas from the interior of the first (smaller) hollow shaft can enter the interior of the second (larger) hollow shaft.

The gas permeability of the material of the first (smaller) hollow shaft can be provided by holes with a diameter of 1 to 5 mm that are arranged or distributed at various positions. The use of slits in the material or a (rigid) mesh would also be conceivable.

The first (smaller) hollow shaft and the second (larger) hollow shaft are preferably composed of a metallic or a non-metallic material. Both of the hollow shafts can be formed in one piece.

The hollow shaft used in the present invention can be described as a type of hollow cylinder, wherein a hollow space or a hollow volume is provided between the inner and outer circumferential surfaces, and wherein the inner circumferential surface is gas-permeable.

In the present invention, a device for generating gas bubbles in a liquid, more particularly microbubbles, is provided which allows bubble production by means of suitable gassing discs. For this purpose, the compressed gas is introduced into the horizontally mounted rotatable hollow shaft (composed of a smaller inner and a larger outer hollow shaft) and fed via the gassing discs, which are composed for example of a ceramic membrane with a gas channel, into the liquid. The use of two hollow shafts lying inside one another allows uniform and symmetrical distribution of pressure inside the larger hollow shaft. The discs are thus symmetrically supplied with gas, and uniform bubble production in the medium to be gassed is achieved.

As explained below, the ceramic membrane has a pore size, for example, of 2 μm, which results in the formation of bubbles with a bubble size of between 40 and 60 μm. Because of the rotation of the hollow shaft and the ceramic discs mounted on the hollow shaft, shear forces act on the air bubbles coming out of the ceramic discs that affect the size of the gas bubbles and the gas foam. The strength or magnitude of the acting shear forces thus directly affect the efficiency of bubble formation. The strength of the shear forces per se is in turn affected by the rotation speed of the hollow shaft, wherein the rotation speed of the hollow shaft can be up to 250 rpm. The dirt particles contained in the liquid (such as organic substances or biological substances) then attach themselves to the bubbles formed in the liquid in the form of a foam and rise in the form of a corresponding gas-bubble agglomerate to the surface of the liquid. The solid layer formed on the surface of the liquid as a result can then be mechanically separated. The specific combination of gas oscillation, direct gas injection in the feed line and hollow shaft, and the vertical arrangement of the gassing discs on the horizontal hollow shaft make it possible to produce minute bubbles in an energetically favorable and thus economical manner, which makes large-scale application of the device appropriate.

In an embodiment of the present device, two horizontally rotatable hollow shafts are arranged parallel and offset with respect to each other. Each of the hollow shafts has at least one gassing disc, preferably at least two, and particularly preferably at least three or more gassing discs. In general, it is also possible and conceivable for not only 1 to 4, but also 10 to 100, preferably between 15 and 50, and particularly preferably between 20 and 30 gassing discs to be arranged on the at least one hollow shaft, wherein the number of ceramic discs is determined by the required amount of gas. The distance between the ceramic discs arranged on a hollow shaft is at least 2 cm.

In the case of use of a device with two horizontal shafts arranged parallel and offset with respect to each other, at least one gassing disc rotates on a first hollow shaft in the same direction as at least one gassing disc arranged on the second hollow shaft in a parallel and offset manner. Accordingly, the gassing discs engage with one another in an offset manner. In this case, there is a phase shift of 180°. Here, "offset" within the meaning of the present invention means that the hollow shafts are arranged laterally or spatially offset with respect to each other; this means that the shaft mountings or shaft bearings of the respective hollow shafts are preferably shifted along a horizontal plane with respect to one another by a specified distance. The gassing discs, which in a variant are arranged in the same manner on each of the respective hollow shafts, thus do not touch one another because of the offset arrangement of the hollow shafts, but engage with one another in an offset manner. In another variant of the device, however, a mixed arrangement of the individual gassing discs is also conceivable and possible. In this case, the hollow shafts would be arranged in each case parallel to one another, i.e. the respective shaft mountings are parallel to one another, but the gassing discs cannot be provided on the respective hollow shaft in a fixed predetermined configuration, but are arranged on each hollow shaft at a different distance from the respective gas feed line to the hollow shaft. This distance can be set such that the gassing discs can engage with one another in an offset manner.

In a variant of the present device, the at least one hollow shaft rotates at a rotation speed of between 10 and 250 rpm, preferably between 100 and 200 rpm, and particularly preferably between 150 and 180 rpm. In the case of use of two hollow shafts arranged parallel and offset with respect to each other, a slower rotation, for example between 50 and 100 rpm, may be sufficient. The rotation speed of the hollow shafts and thus also the rotation speed of the gassing discs, as well as the amount of gas and the gas pressure, can be modified during operation of the device depending on the desired extent of bubble formation, i.e. the number and size of the bubbles and their online (life).

In a further variant of the present device, the compressed gas to be introduced is selected from at least one compressed gas in the group composed of air, carbon dioxide, nitrogen, ozone, methane, or natural gas. Methane is used more particularly in removing oil and gas from a liquid, such as, for example, in the case of purification of a liquid accumulating in fracking. Ozone can in turn be used because of its oxidative and antibacterial properties for water purification from aquaculture.

The compressed gas is directly introduced into the at least one feed line and then into the at least one hollow shaft without a liquid carrier. Accordingly, injection of the compressed gas takes place directly from a gas reservoir, such as, for example, a gas cannister or a corresponding gas line. The gas therefore does not require a liquid carrier, as would be needed for example in the case of DAF, so that the need for a recycling stream and a saturation column is obviated and no compaction energy is required in order to achieve a high level of pressure in the DAF recycling stream. A further advantage of direct injection of a compressed gas without a liquid carrier is that it allows the simple and low-energy production of microbubbles.

The gas pressure of the gas introduced into the at least one hollow shaft is between 1 and 5 bar, and preferably between 2 and 3 bar. In order to reach this pressure level in the hollow shaft, the at least one compressed gas is fed into the gas feed line at a pressure of between 5 and 10 bar. The pressure profile inside the hollow shaft is preferably constant.

In a further embodiment of the present device, the at least one gassing disc is preferably composed of a ceramic material having an average pore size of between 0.05 μm and 10 μm, preferably between 0.1 and 5 μm, and particularly preferably between 2 and 3 μm. In this case, a pore size of 2 μm is most advantageous.

The average bubble diameter of the gas bubbles introduced via the gassing disc or gassing membrane into the liquid can be between 10 μm and 200 μm, preferably between 20 μm and 100 μm, particularly preferably 30 to 80 μm, and most particularly preferably 50 μm. The bubble production at the gassing membrane or gassing disc can more particularly be influenced via a suitable volumetric gas flow rate and pressure. The higher the pressure, the greater the number and the larger the size of the bubbles produced. In the present case, the specified flow rate plays only a secondary role.

The gassing disc has an outer diameter of between 100 and 500 mm, and preferably between 150 and 350 mm. Ceramic has been found to be a particularly suitable material for the gassing discs, more particularly the aluminium oxide $\alpha$-$Al_2O_3$. However, other ceramic oxides and non-oxides such as silicon carbide or zirconium oxide can also be used.

The ceramic discs can be clamped onto the hollow shaft in at least one area (clamping area) and are simultaneously sealed via the clamping with seals composed of any desired materials. Each of the at least one clamping areas is delimited by two end pieces. The ceramic discs are preferably spaced relative to one another by means of connecting pieces (spacers) that are composed of metallic or non-metallic materials and may have varying measurements or dimensions. Here, the present construction composed of hollow shafts, end pieces, connecting pieces and ceramic discs is rotatable.

In a further variant of the present device, the at least one hollow shaft is produced from stainless steel, such as, for example, V2A or 4VA, duplex or super duplex material, or plastic. The total diameter of the hollow shaft is between 10 and 50 mm.

As indicated above, each of the at least one hollow shafts is arranged in two shaft mountings with corresponding bearings. The at least one feed line for feeding the compressed gas into the hollow shaft is provided on one side or at one end of the hollow shaft, while a corresponding motor for rotation of the hollow shaft is arranged and for example connected via a drive shaft at the end of the hollow shaft lying opposite the feed line for the gas. Such motors for driving hollow shafts are known and can be selected in a diverse manner depending on the size of the system.

In a further embodiment of the present device, at least one device for generating a pulse of the compressed gas is provided in the at least one feed line. This device for generating a pulse can produce a pulse of the compressed gas at a frequency of between 5 and 15 Hz, preferably between 7 and 13 Hz, and particularly preferably between 9 and 11 Hz. In use of a pulsating (or oscillating) gas for producing the gas bubbles in the present device, the energy requirement is reduced, as is the required gas pressure.

In a variant of the present device, the at least one device for generating a pulse is a fluidic oscillator, an automatic valve, for example in the form of a magnetic valve, and/or a displacement compressor, for example in the form of a piston compressor. In general, it is also possible for the pulse of the compressed gas in the feed line to be produced in the form of pulsating compressed air.

In a further embodiment of the present device, during each pulse, the device for generating a pulse produces gas reflux of <10 percent, and preferably >9 percent, or >30 percent, and preferably >35 percent.

As mentioned above, a pulse frequency, more particularly an oscillation frequency, of the compressed gas of between 9 and 11 Hz is particularly preferred, as at this frequency, microbubbles with an average bubble diameter of approx. 50 μm are produced. In contrast, at an elevated frequency above 10 Hz, for example 15 Hz, the bubble diameter is larger than at a lower frequency.

On the other hand, if no oscillation frequency is applied, a bubble diameter of only 60 μm and above is produced.

The present device is used in a method for generating gas bubbles in a liquid in a container comprising the following steps:

- introduction of a compressed gas into at least one feed line, wherein the compressed gas is directly introduced into the feed line without a liquid carrier;
- introduction of the compressed gas into at least one horizontally arranged rotating hollow shaft, more particularly the first rotatable hollow shaft; wherein the at least one hollow shaft rotates at a rotation speed of between 10 and 250 rpm, preferably between 100 and 200 rpm, and particularly preferably between 150 and 180 rpm, and
- introduction of the compressed gas into the liquid while producing gas bubbles by means of at least one gassing disk arranged vertically on the horizontally rotating hollow shaft.

With the present method, it is possible to produce bubbles in the liquid with a bubble size of between 1 μm and 200 μm, preferably between 20 μm and 100 μm, particularly preferably between 30 and 89 μm, and most particularly preferably between 45 μm and 50 μm.

In a preferred variant, the present device for generating gas bubbles is used in a system for the purification of a liquid, preferably water, and more particularly for the purification or pre-purification of salt water, sludge-containing wastewater, or other polluted liquids.

Such a system for purification of a liquid, such as, for example, water, comprises at least one container with a device for generating gas bubbles according to the above description and at least one container (flotation cell) for accommodating the at least one liquid mixed with gas bubbles, wherein this container comprises at least one filtration unit for separating organic components contained in the liquid.

In a variant of the present arrangement, at least one flocculation unit for accommodating the liquid to be purified and for accommodating the at least one flocculating agent for flocculation of the components contained in the liquid can be installed upstream of the container with the device for producing gas bubbles.

In a further variant of the present system, the at least one flocculation unit, the at least one device for producing gas bubbles, and the at least one container (flotation cell) with the at least one filtration unit can be connected to one another such that they are in fluid communication with one another, so that the liquid to be mixed with the flocculating agent can be transported from the flocculation unit into the device for producing gas bubbles and from this device into the container (flotation cell) with the filtration unit.

The flocculation unit can be configured either as an individual unit separated from the other containers, or may be connected in an integral manner to the further containers. A suitable flocculation agent, e.g., for example, $Fe^{3+}$ or $Al^{3+}$ salts such as $FeCl_3$, can be introduced into the liquid to be purified, such as, for example, the water to be purified, and optionally thoroughly mixed with the liquid using a stirrer. The liquid mixed with the flocculating agent in the flocculation unit is then preferably transferred into the at least one container using the device for producing gas bubbles in the form of a liquid stream, wherein the liquid stream is mixed in this container with gas bubbles introduced using the device for generating gas bubbles.

The agglomerate of gas bubbles and flocculated organic components produced in this process is then fed into the further container (flotation cell) with the at least one filtration unit, wherein the gas bubble agglomerate and the flocculated organic components in the flotation cell rise to the surface of the liquid, collect there, and are mechanically separated. The liquid separated in this manner from most of the organic components is then drawn off by the filtration unit arranged on the bottom surface of the flotation cell and fed on for further treatment steps. Accordingly, in an embodiment of the present system, the at least one filtration unit in the flotation cell is arranged below the layer formed by the flocculated organic components that have risen to the surface. It is particularly preferable if the at least one filtration unit is arranged at the bottom of the flotation cell and is accordingly provided immersed in the liquid area of the flotation cell.

More particularly, the filtration unit has a rectangular shape adapted to the container (flotation cell). The length of the filtration unit preferably corresponds to 0.5 to 0.8 times, and particularly preferably 0.6 times the length of the flotation cell. The width of the filtration unit preferably corresponds to 0.6 to 0.9 times, and particularly preferably 0.8 times the width of the flotation cell. The filtration unit therefore does not extend over the entire width of the flotation cell, but is at a lesser distance from the lateral walls thereof. The height of the filtration unit is preferably configured such that it is in the range of 0.1 to 0.9 times, and preferably 0.6 to 0.7 times the height of the container (flotation cell). Of course, other dimensions are also conceivable for the filtration unit used.

In a preferred embodiment, the at least one filtration unit is present in the form of a ceramic filtration membrane, more particularly in the form of a ceramic micro- or ultrafiltration membrane. Such ceramic filtration membranes show a high degree of chemical resistance and a long service life. Moreover, ceramic filtration membranes are water-permeable and less susceptible to fouling, as they show higher hydrophilicity than polymer membranes. Because of their mechanical stability, they do not require prescreening.

It has been found that a membrane module having an average pore size of 20 nm to 500 nm, preferably 100 nm to 300 nm, and particularly preferably 200 nm is particularly suitable. The preferably used filtration membrane module can be composed of a plurality of plates, one or a plurality of tubes, or further geometric shapes. A particularly suitable ceramic material has been found to be aluminum oxide in the form of $\alpha$-$Al_2O_3$, but other ceramic oxides or non-oxides such as silicon dicarbide or zirconium oxide can also be used in the filtration unit.

In a further preferred embodiment, the system, here more particularly the flotation cell, comprises a means for aeration of the filtration unit in order to suitably aerate said at least one filtration unit. A suitable aeration means may for example be present in the form of a perforated hose. The aeration means can be supplied with air in order to apply high shear forces to the surface of the filtration unit in order to prevent or minimize fouling on the membrane surface. Further possibilities for the prevention or reduction of fouling of the filtration unit are treatment with suitable chemical substances, such as citric acid, in order to prevent inorganic fouling or treatment with a suitable oxidizing agent, such as sodium hydrochloride, for example, in order to reduce biological fouling.

Accordingly, the system described can be used in a method for purification of a liquid, more particularly for water purification, such as, for example, for the purification or pre-purification of seawater. Such a method comprises the following steps:

- optional introduction of the liquid to be purified into at least one flocculation unit and addition of at least one flocculating agent to the liquid to be purified in order to flocculate components present in the liquid, such as, for example, organic components,
- transferring of the liquid optionally mixed with the at least one flocculating agent to at least one container arranged downstream with a device for generating gas bubbles and bringing into contact of the liquid optionally mixed with the flocculating agent with the gas bubbles introduced into this container in order to form a gas bubble agglomerate, more particularly a flake-gas microbubble agglomerate,
- transferring of the liquid mixed with the gas bubbles and the optional flocculating agent to a flotation cell, wherein the gas bubble agglomerate that has risen to the surface of the flotation cell is separated,
- drawing off of the liquid depleted of the gas bubble agglomerate by the at least one filtration unit arranged in the filtration unit, and
- feeding of the liquid drawn off by the filtration unit on for further treatment steps.

Accordingly, the present method constitutes a hybrid process composed of gas bubble production using gassing discs vertically arranged on a hollow shaft, microflotation, and membrane filtration in a singular device unit.

BRIEF DESCRIPTION OF THE DRAWINGS

The invention is explained in further detail below with reference to the figures by means of examples in the drawings. The figures are as follows.

DETAILED DESCRIPTION OF THE INVENTION

Figure 1A:
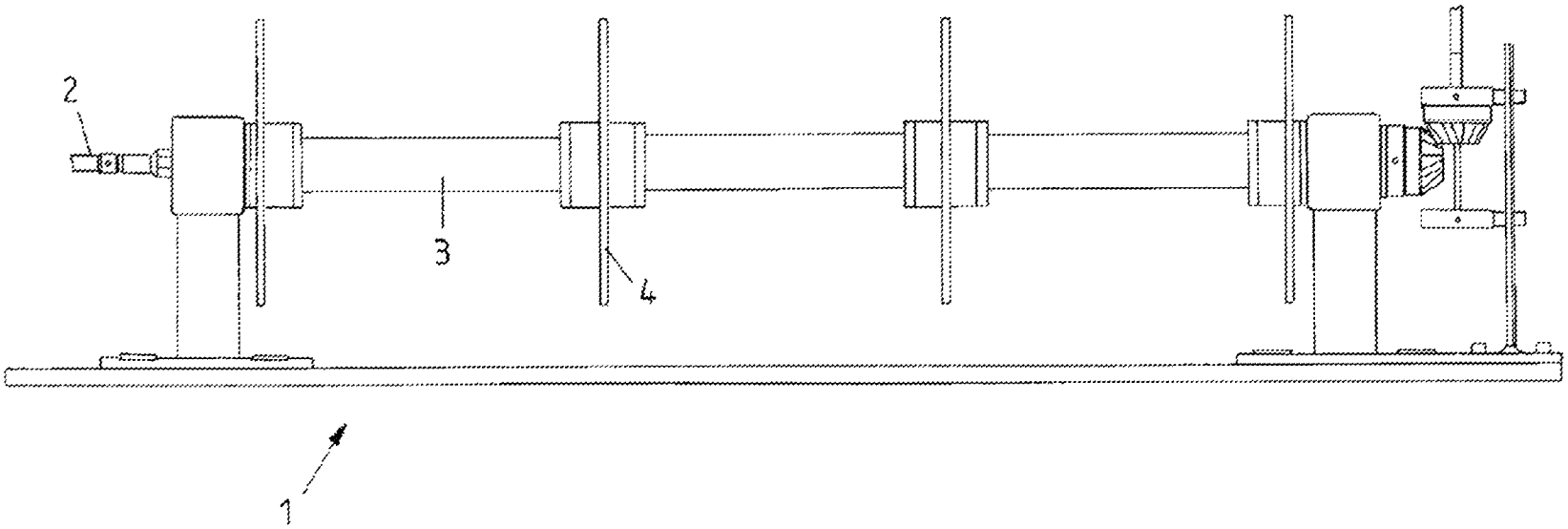
FIG. 1A shows a first schematic side view of a device for producing gas bubbles in a liquid according to an embodiment.

The general structure of a first embodiment of the device according to the invention for producing gas bubbles is shown in FIG. 1A.

The side view of FIG. 1A shows a device 1 with a feed line 2 for feeding the compressed gas and a hollow shaft 3 through which the compressed gas is further introduced into the gassing discs 4.

In the embodiment shown in FIG. 1A, four circular gassing discs of a ceramic material are arranged on the hollow shaft. The ceramic discs are composed of aluminum oxide and have an outer diameter of 152 mm and an inner diameter of 25.5 mm. The membrane surface area is 0.036 $m^2$, and the pore size of the gassing discs is in the range of 2 μm. The gas is introduced from the hollow shaft 3 into a hollow cavity of the ceramic disc 4 and penetrates from the inside of the hollow cavity through the pores of the ceramic material into the liquid to be purified, which is provided around and above the hollow shaft having the gassing discs, forming microbubbles with a bubble size of approx. 45 to 50 μm. The gassing discs 4 are arranged on the hollow shaft by means of stainless steel or plastic fastening elements. The distance of the gassing discs from one another can be set as desired.

At the end of the hollow shaft 3 opposite the gas feed line 2, a suitable device for moving the hollow shaft is provided. This device can be provided in the form of a motor that transfers the corresponding rotary movement via a plurality of gears to the hollow shaft.

Figure 1B:
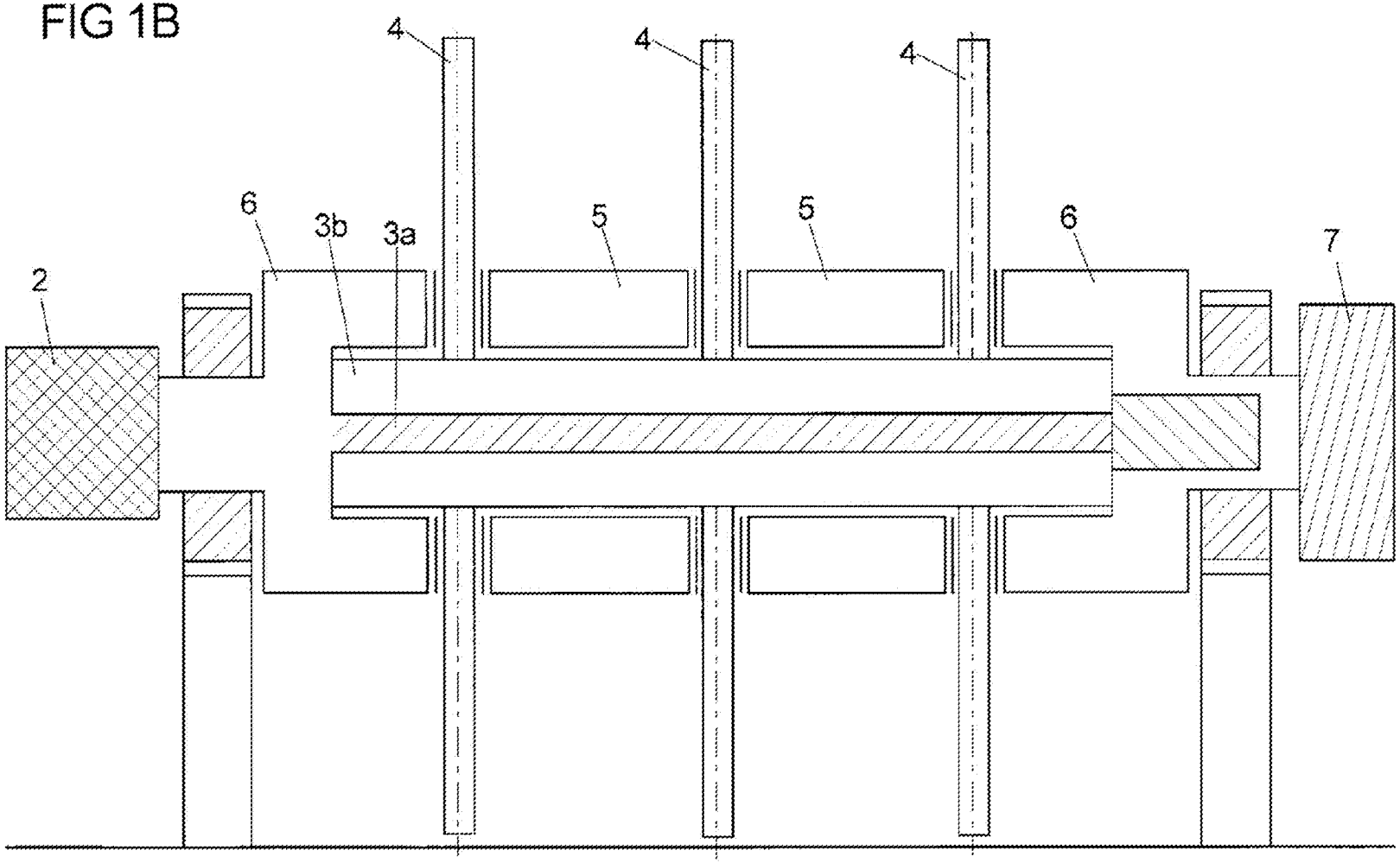
FIG. 1B shows a second schematic side view of a device for producing gas bubbles in a liquid according to an embodiment.

The embodiment shown in FIG. 1B illustrates the structure of the hollow shaft 3. The latter is composed of two hollow shafts 3*a*, 3*b* lying inside one another: a hollow shaft of smaller diameter 3*a* that is arranged inside a second hollow shaft of larger diameter 3*b*. This principle makes it possible to achieve a highly uniform and symmetrical distribution of pressure inside the hollow shaft 3*b* of larger diameter. The ceramic discs 4 are thus symmetrically supplied with gas, and uniform bubble production in the medium to be gassed is achieved. The shafts 3*a*, 3*b* can be produced from metallic or nonmetallic materials.

The ceramic discs 4 are clamped onto the shaft in at least one clamping area, and at the same time sealed via this clamping using seals composed of any desired materials. Each of the at least one clamping areas is delimited by two end pieces 6.

Connecting pieces 5, which are composed of metallic or non-metallic materials and may be of varying dimensions, are used as spacers between the ceramic discs 4. It is essential that the entire apparatus composed of hollow shafts 3*a, b*, end pieces 6, connecting pieces 5, and ceramic discs 4 must rotate.

The drive 7 for rotational movement of the shaft can be located directly on the shaft, but can also be driven via various mechanical force deflection means, such as bevel gears or 90° reduction gearboxes. The drive 7 of the shaft can therefore be positioned on the one hand in a medium to be gassed, but on the other also outside of the medium to be gassed. However, the drive 7 can also be provided via any known type of drive (such as an electrical, hydraulic, or pneumatic drive).

The shaft 3*a, b* can be supported at least two positions, with various types of bearings being suitable for use, such as ball bearings, grooved ball bearings, needle bearings, and roller bearings. Gas introduction 2 into the rotating shaft must take place via at least one seal. The latter can be positioned inside or outside of the medium to be gassed. The drive 7 and gas introduction 2 into the shaft can be configured in any desired position on the shaft.

Figure 2A:
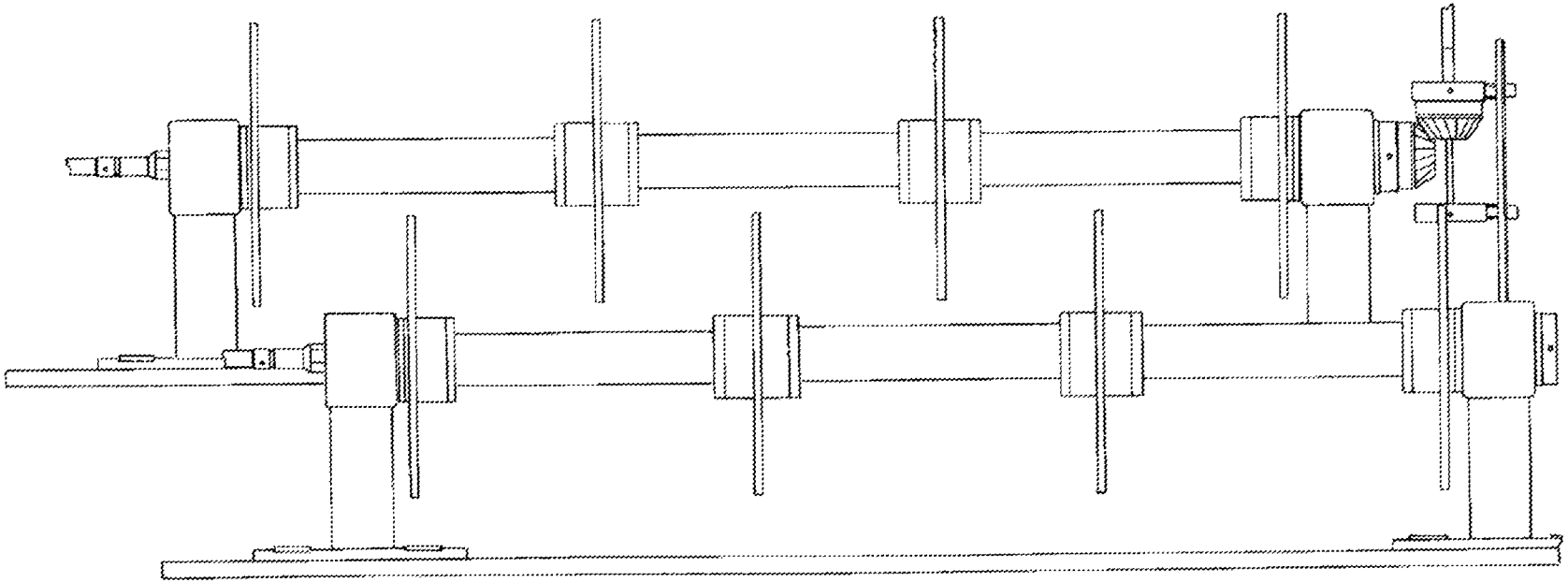
FIG. 2A shows a schematic view of two hollow shafts arranged parallel and offset with respect to each other with a plurality of gassing discs according to a second embodiment.
Figure 2B:
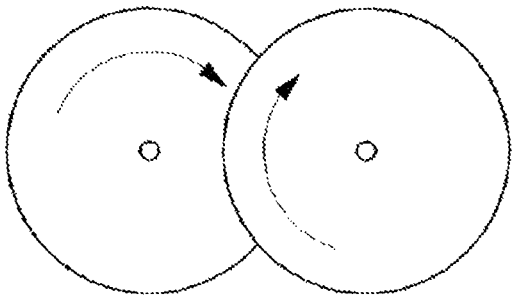
FIG. 2B shows a schematic side view of the rotating gassing discs.

The view of FIG. 2A shows two hollow shafts, each having four gassing discs, which are arranged parallel and offset with respect to one another. The gassing discs on each of the hollow shafts move in the same direction and engage with one another because of the offset horizontal arrangement (FIG. 2B). Such an arrangement of two parallel hollow shafts with the corresponding gassing discs allows the production of a large number of gas microbubbles and thus a high surface area of gas bubbles available for the attachment of foreign matter such as, for example, organic components. Accordingly, a high specific surface area is available to which the hydrophobic solid particles from the liquid to be purified can attach themselves, thus allowing separation of the organic foreign matter from the liquid to be purified by means of flotation.

As described above in detail, the present device for producing gas bubbles can also comprise at least one fluidic oscillator that is provided in one of the gas feed lines 2. A gas bubble diameter of 45 to 50 μm is ensured by producing oscillation of the gas at approx. 9 to 10 Hz. Accordingly, a bubble size of between 45 and 50 μm is ensured in combination with the gassing discs arranged on the hollow shaft.

Figure 3:
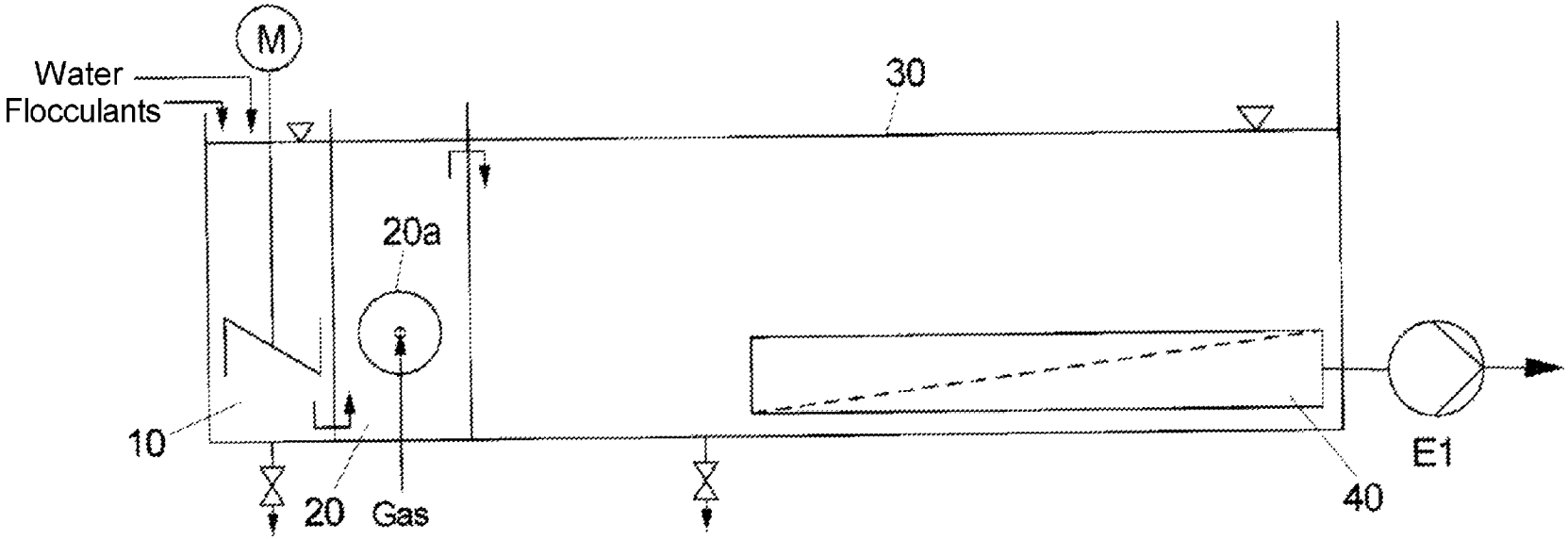
FIG. 3 shows a schematic side view of a system for purification of a liquid comprising a device for producing gas bubbles.

FIG. 4, in turn, shows a schematic view of a system 20 for purification of a liquid, more particularly water, which comprises at least one of the above embodiments of a device for producing gas bubbles. The side view of the system 20 in FIG. 3 shows a flocculation unit 10 into which the water to be purified and the flocculating agent have been introduced. After mixing of the water to be purified with the flocculating agent, for example using a stirrer, the mixture can be introduced from the flocculation unit 10 via a dividing wall into a further separate section or container 20, in which at least one hollow shaft 20*a* with four gassing discs according to the embodiment of FIGS. 1A and 1B is provided.

In the present experimental method, wastewater that has been mixed with humic substances is used. In this case, the entire content of organic substances in the wastewater is simulated by humic substances, which also occur in nature due to normal biological decay. For flocculation of the humic substances contained in the water, iron and aluminum-containing substances containing trivalent ions are primarily suitable as precipitants. In the present case, an $FeCl_3$ solution is used as a flocculating agent. After addition of the flocculating agent using a static mixer, flocculation of the humic acids contained in the wastewater takes place in the flocculation unit 10 by means of the flocculating agent $FeCl_3$.

After passing through the flocculation unit 10, the wastewater mixed with $FeCl_3$ from the flocculation unit 10 is introduced into the container 20 containing the gassing device composed of a hollow shaft with four gassing discs at a flow rate of 400-700 l/hr.

Air is injected via the gassing device 20*a* in the container 20, thus causing the direct formation of microbubbles in the introduced water mixed with a flocculating agent. The gassing discs or gassing plates of the gassing device rotate in the same direction at a rotation speed of 180 rpm, resulting in a phase shift of 180°. The microbubbles formed attach themselves to the flakes to form flake-air bubble agglomerates, which are introduced in the further course of the method into the flotation cell 30 provided downstream. Due to attachment of the microbubbles to the flocculated organic components, the agglomerates thus formed rise in the flotation cell in the direction of the surface of the liquid present in the flotation cell 30 and form a solid layer on the surface of the water that is mechanically separated, for example using scrapers. The pre-purified water is located in the flotation cell 30 below this solid layer. The water pre-purified in this manner is withdrawn using a suitable pump by the filtration unit 40 arranged in the flotation cell 30 and is available for further treatment, such as, for example, further desalination processes. In order to prevent fouling of the surface of the filtration unit 40, air can be directly fed onto the surface of the filtration unit 40 via perforated hoses, thus mechanically removing deposits on the surface of the filtration unit 40.

The invention claimed is:

1. A device for generating gas bubbles in a liquid in a container, wherein at least one rotatable hollow shaft is arranged horizontally in at least one container, wherein each of the at least one hollow shaft comprises a first hollow shaft with a diameter $d_{3a}$ and a second hollow shaft with a diameter $d_{3b}$, and wherein $d_{3a}<d_{3b}$, such that the first hollow shaft is arranged inside the second hollow shaft;

wherein the at least one first rotatable hollow shaft is composed of a perforated material, such that the gas can enter from the interior of the first hollow shaft into the interior of the second hollow shaft;

wherein at least one ceramic gassing disc is arranged vertically on the second hollow shaft and with an average pore size of between 0.1 μm and 10 μm; and wherein there is at least one feed line for supplying at least one compressed gas to the interior of the first rotatable hollow shaft, wherein the compressed gas is directly introduced into the feed line and the hollow shaft without a liquid carrier.

2. The device as claimed in claim 1, wherein the at least one first rotatable hollow shaft is composed of a gas-permeable material.

3. The device as claimed in claim 1, comprising at least two rotatable hollow shafts arranged parallel and horizontally offset with respect to each other, each of which has at least one gassing disc.

4. The device as claimed in claim 1, wherein at least two gassing discs are arranged on the second rotatable hollow shaft.

5. The device as claimed in claim 1, wherein between 10 and 100 gassing discs are arranged on the second rotatable hollow shaft.

6. The device as claimed in claim 1, wherein the at least one hollow shaft is rotatable at a rotation speed of between 10 and 250 rpm.

7. The device as claimed in claim 1, further including the at least one compressed gas, wherein the at least one compressed gas is selected from the group composed of air, $CO_2$, $N_2$, ozone, methane, and natural gas and wherein the at least one compressed gas is in the feed line.

8. The device as claimed in claim 1, further including the at least one compressed gas, wherein the at least one compressed gas is in the at least one rotatable hollow shaft and wherein the at least one compressed gas has a pressure of between 1 and 5 bar.

9. The device of claim 4, wherein at least three gassing discs are arranged on the second rotatable hollow shaft.

10. The device as claimed in claim 1, wherein at least one device for generating a pulse of the compressed gas is provided in the at least one feed line.

11. The device as claimed in claim 10, wherein the at least one device for generating a pulse in the compressed gas is adapted to generate a pulse of the compressed gas with a frequency of between 5 and 15 Hz.

12. The device as claimed in claim 10, wherein the at least one device for generating a pulse is a fluidic oscillator, an automatic valve and/or a displacement compressor.

13. A method for generating gas bubbles in a liquid in a container using at least one device as claimed in claim 1, wherein the method comprises:

introduction of a compressed gas into at least one feed line, wherein the compressed gas is directly brought into the at least one feed line without a liquid carrier;

introduction of the compressed gas into the interior of the at least one horizontally arranged rotatable hollow shaft; wherein the at least one hollow shaft rotates at a rotation speed of between 10 and 250 rpm, and introduction of the compressed gas through at least one gassing disc vertically arranged on the second hollow shaft into the liquid with the production of gas bubbles.

14. The method as claimed in claim 13, wherein the gas flowing in the at least one feed line is subjected to pulsation at a frequency of between 5 and 15 Hz using at least one device for generating a pulse arranged in the at least one feed line.

15. A system for purification of a liquid comprising at least one container with a device for producing bubbles as claimed in claim 1, and at least one container in the form of a flotation cell for accommodating the liquid mixed with the bubbles having at least one filtration unit for separating components contained in the liquid.

16. A method for water purification using a system as claimed in claim 15, wherein the liquid comprises water.

17. The device of claim 1, wherein the at least one feed line is configured to supply the at least one compressed gas to the interior of the first hollow shaft.

18. The device according to claim 1, wherein the diameter of the first hollow shaft and the second hollow shaft is between 10 and 50 mm.

19. The device according to claim 1, wherein the first hollow shaft is made of a gas permeable material comprising holes with a diameter of 1 to 5 mm or slits that are arranged or distributed at various positions.

20. The device according to claim 1, wherein the first hollow shaft is made of a rigid mesh.

21. The device according to claim 1, wherein first hollow shaft and the second hollow shaft are composed of a metallic material.

22. The device according to claim 1, wherein the at least one hollow shaft is produced from one material from the group comprised of stainless steel.

* * * * *